US005291940A

United States Patent [19]

Borofka et al.

[11] Patent Number: 5,291,940

[45] Date of Patent: Mar. 8, 1994

[54] STATIC VACUUM CASTING OF INGOTS

[75] Inventors: Janine C. Borofka, Glenmoore; Robert A. Borowski, West Chester; Charles H. Entrekin, Coatesville; Howard R. Harker, Malvern, all of Pa.

[73] Assignee: Axel Johnson Metals, Inc., Lionville, Pa.

[21] Appl. No.: 759,422

[22] Filed: Sep. 13, 1991

[51] Int. Cl.[5] ..... B22D 27/02

[52] U.S. Cl. ..... 164/494; 164/512; 164/469; 164/122.1

[58] Field of Search ..... 164/469, 470, 494, 495, 164/496, 506, 508, 512, 514, 122.1, 338.1

[56] References Cited

U.S. PATENT DOCUMENTS

| | | | |
|---|---|---|---|
| 3,581,809 | 6/1971 | DeWeese et al. | 164/325 |
| 3,646,175 | 2/1972 | Bomberger, Jr. et al. | 75/333 |
| 3,702,748 | 11/1972 | Storb et al. | 425/6 |
| 3,744,943 | 7/1973 | Bomberger, Jr. et al. | 425/6 |
| 3,869,232 | 3/1975 | Ruus et al. | 164/130 |
| 4,190,404 | 2/1980 | Drs et al. | 164/494 |
| 4,215,084 | 7/1980 | Maringer | 164/130 |
| 4,838,340 | 6/1989 | Entrekin et al. | 164/455 |
| 4,932,635 | 6/1990 | Harker | 75/10.13 |
| 4,936,375 | 6/1990 | Harker | 164/469 |

FOREIGN PATENT DOCUMENTS

| | | | |
|---|---|---|---|
| 62-176665 | 8/1987 | Japan | 164/494 |
| 63-212061 | 9/1988 | Japan | 164/494 |

*Primary Examiner*—Kuang Y. Lin

*Attorney, Agent, or Firm*—Brumbaugh, Graves, Donohue & Raymond

[57] ABSTRACT

In the disclosed embodiments, vacuum casting of metal ingots is effected by melting metal in a hearth, directing molten metal from the hearth through a hearth outlet to one of a series of mold segments positioned on the periphery of a rotatable drum, and directing an energy beam from an electron gun or plasma gun toward the surface of the molten metal being poured into the mold segment to control solidification of the ingot. After the mold segment has been filled, the drum is indexed to position an adjacent mold segment beneath the hearth outlet. The energy beam is directed toward the surface of the completed ingot in the adjacent segment as well as toward the mold segment being filled to form a smooth surface on the solidified ingot.

12 Claims, 1 Drawing Sheet

STATIC VACUUM CASTING OF INGOTS

BACKGROUND OF THE INVENTION

This invention relates to casting of molten metal into ingot form and, more particularly, to static vacuum casting of ingots.

Vacuum refining and casting of ingots, as described, for example, in U.S. Pat. No. 4,838,340 to Entrekin et al. and U.S. Pat. Nos. 4,932,635 and 4,936,375 to Harker, has been completed by pouring molten metal into a vertically disposed water-cooled mold in which an ingot is formed and solidified and drawn downwardly as molten metal is added to the top of the mold. Because of the relative motion between the metal being solidified and the adjacent cold surface of the mold, laps and cold shuts tend to be formed, producing an ingot with a rough surface which must be ground or otherwise treated if a smooth-surfaced ingot is desired. Moreover, the cross-sectional shape of the ingot must be uniform throughout its length since it is determined by the cross-sectional configuration of the mold.

The patent to DeWeese et al., U.S. Pat. No. 3,581,809, discloses a continuous casting device in the shape of a continuously rotating drum having water-cooled molds at its peripheral surface into which molten metal is poured as the drum is rotated. Such continuous casting into separate mold elements followed by rapid cooling and solidification leads to shrinkage porosity within and at the surface of the molded ingots and may result in solidified metal bridges which physically connect adjacent ingots and makes it difficult to separate the ingots from the mold.

Furthermore, such casting arrangements rely on high metal casting rates to maintain a steady stream of metal into a mold and minimize the time for heat loss from the source to the mold. However, if the melting, refining and casting processes are in line, this can require flow rates above the desired or possible melting and refining capabilities of the system. Moreover, a high casting rate requires a correspondingly high solidification rate, resulting in porous castings.

SUMMARY OF THE INVENTION

Accordingly, it is an object of the present invention to provide a method and apparatus for vacuum casting of metals which overcomes the above-mentioned disadvantages of the prior art.

Another object of the invention is to provide a new and improved arrangement for vacuum refining and casting of metals capable of producing varying ingot configurations.

A further object of the invention is to provide an arrangement for vacuum refining and casting of metal capable of producing ingots having smooth surfaces.

These and other objects of the invention are attained by providing a vacuum furnace having a melting hearth with an outlet and a plurality of separate selectively positionable. mold elements into which molten metal can be selectively directed from the outlet, along with a directionally controllable energy source for selectively directing energy toward each of the mold segments to control the solidification of molten metal in the mold segments.

In one embodiment, the mold segments are disposed around the peripheral surface of a drum which is movable at or beneath the outlet from a cold hearth in a vacuum furnace and a directionally controllable energy source, which may be an electron beam gun or a plasma torch, is arranged to direct energy in a controlled manner toward the surface of the metal being poured into a mold segment. The energy source may also be directed toward the surface of the metal in an adjacent filled mold segment in order to control the solidification rate and prevent ingot porosity and surface roughness resulting from shrinkage as the metal solidifies.

Alternatively, the mold segments may be disposed at the upper surface of a rotatable disk or in a revolving magazine or be carried by a horizontal or vertical conveyor arrangement.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
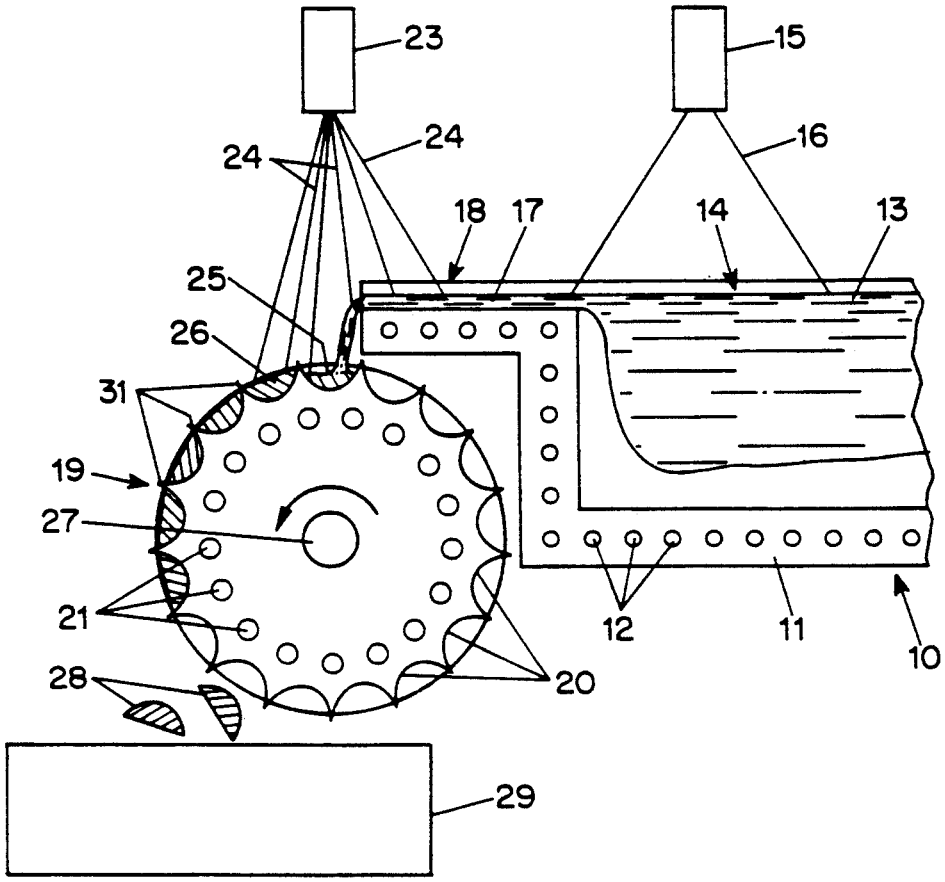
FIG. 1 is a schematic longitudinal sectional view illustrating a representative embodiment of the invention utilizing a drum having mold segments disposed about its peripheral surface.

In the typical embodiment of the invention illustrated by way of example in the drawings, a vacuum furnace has a cold hearth 10 comprising a hearth bed 11 containing cooling passages 12 through which water or another cooling liquid may be circulated. At an inlet end of the hearth (not illustrated in the drawings), raw material to be refined is supplied to a melt area (not shown in the drawings) in the form of an ingot or fragments or compacted briquettes of the metal which is to be refined. After melting, the metal forms a pool 13 of molten material which flows toward a refining area 14 of the hearth where a directionally controllable energy source 15, such as an electron beam or plasma gun, directs a controllable beam 16 of energy toward the pool 13.

Following refining of the metal in the pool 13, the molten material flows in a stream 17 through an outlet 18 to a casting drum 19 which is provided with a series of mold segments 20 disposed around its peripheral surface. To promote solidification of the molten metal, a series of cooling passages 21 is arranged to conduct water or other coolant through the drum at locations adjacent to the mold segments 20. In order to control the rate of cooling and solidification in such a way as to avoid internal shrinkage porosity and surface irregularities and thereby provide nonporous and smooth-surfaced ingots, another directionally controllable energy source 23, such as an electron beam gun or plasma torch, is positioned to selectively direct energy beams 24 toward the stream 17 of molten metal flowing to the mold through the outlet 18, toward the mold cavity 25 which is receiving molten metal from the outlet, and toward the surface of the metal in the adjacent mold segment 26 which has been filled and is in the process of solidifying. In this way, the absence of internal porosity of the ingot is assured by controlling the solidification rate to minimize shrinkage. In addition, good surface quality is obtained by programming the beam energy to assure uniform and unimpeded flow of molten metal throughout the mold segment.

The drum 19, which is supported on a rotatable shaft 27, is advanced step by step so that each mold segment is maintained in position below the outlet 18 until it is filled, after which the drum is rotated to move the next mold segment into position beneath the outlet. The energy beams 24 are directed toward the mold segment being filled so as to prevent rapid cooling and crystallization of the metal as well as internal shrinkage porosity in the ingot being formed and also toward the surface of the recently completed ingot in the mold segment 26 to assure formation of a smooth, uniform surface as the solidification of that ingot is completed. Furthermore, the beam 24 is directed toward the stream 17 of molten metal in the outlet 18 to create thermal stirring currents which block the transfer of floating oxides into the mold.

As the drum 19 rotates, the solidified ingots 28 fall by gravity from the mold segments as they pass into the lower quadrant of the drum and are collected in a container 29. If desired, mechanical assistance such as an ejector or vibration may be provided to assist in removal of the solidified ingots. The entire hearth arrangement along with its directional energy sources 15 and 23 and the container 29 is surrounded by an evacuated enclosure (not shown) in the usual manner.

Figure 2:
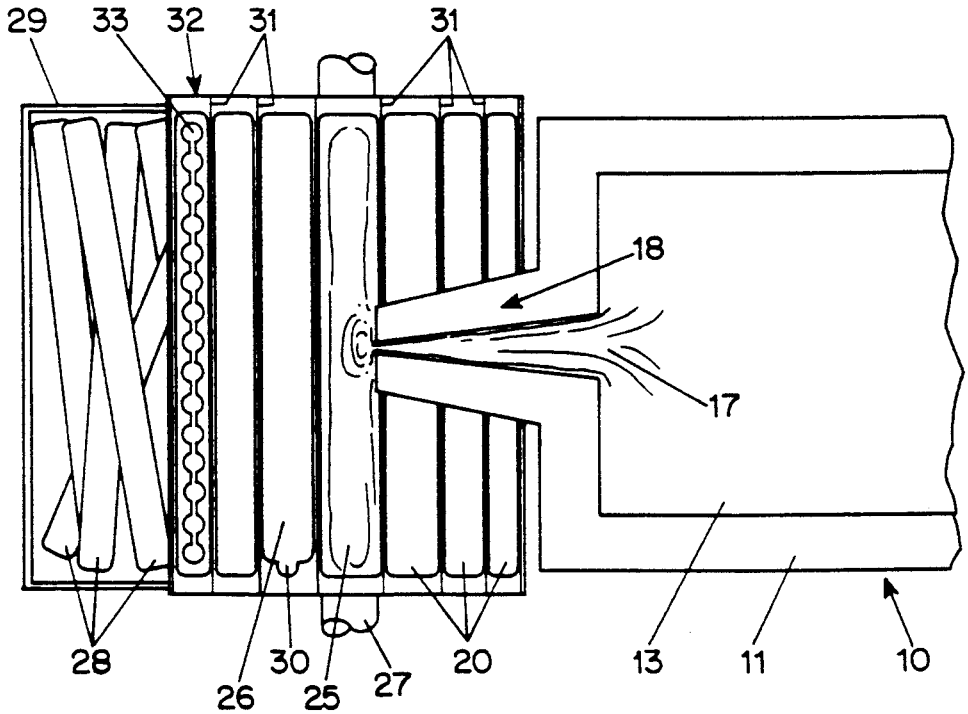
FIG. 2 is a plan view of the typical embodiment of the invention illustrated in FIG. 1.

Since the ingots formed in this manner may be semicircular in cross-section, as shown in FIG. 1, two like ingots may be welded together to form a single ingot of circular cross-section, if desired. In addition, because the ingots are formed by static casting in a fixed mold segment rather than moving through the cross-section of a mold member, the ingots need not be of uniform cross-section and the cavities in the mold segments can be designed to produce any desired ingot configuration. For example, as illustrated by the mold segment 26 seen in FIG. 2, the mold cavity may be formed to produce a tab 30 at one end of an ingot which may be removed as soon as formation of the ingot is completed to permit immediate chemical analysis of the ingot to assure conformance to specification. Moreover, as shown by the mold segment 32, a row of small ingots such as cone-shaped or gumdrop-shaped ingots 33 connected by bridges may be cast in a single mold segment. Such small ingots may be used, for example, for titanium alloy additives in steel manufacture.

In addition, as shown in FIG. 1, with a series of separate mold segments which are selectively held in position beneath the outlet 18, whether disposed at the surface of a drum, as illustrated, or supported on a disk, revolving magazine or other conveyor arrangement, mold segments having different diameter cavities with different capacities may be arranged for consecutive filling from the outlet 18 since the drum or conveyor is not moved continuously. Furthermore, since the mold segments are not connected hydraulically, the ingots formed in adjacent segments are not connected by solid metal bridges and can be separately released from the mold. To avoid undesired formation of such bridges between adjacent segments, the adjacent mold segments are preferably separated by raised ridges 31 so that any molten metal poured between the mold segments as the drum 19 is rotated will flow into one or the other of the adjacent mold segments. Furthermore, with the arrangement of the present invention, if any solid metal bridge is formed between adjacent ingots it can be melted by the energy beam 24 from the energy source 23.

Because the melting, casting and cooling of the metal being refined all take place in a vacuum, reactive metals and alloys can be processed in the usual manner. In this connection, appropriate conventional refining techniques for such vacuum processing may be used and, if desired, on-line chemistry monitoring using X-ray or spectral emission sensors can be utilized to assure proper composition of the molten metal before it is poured into the molds. Moreover, as described above, the energy beam 24 may be used to produce thermal stirring currents at the hearth outlet which exclude any floating oxides from the stream 17 of molten metal as it is poured into the mold segments. If desired, moreover, the energy beam 24 may be selectively directed toward the surface of a completely solidified ingot to produce identifying marks on the surface for future identification of the ingot composition, formulation and processing conditions.

Although the invention has been described herein with reference to specific embodiments, many modifications and variations therein will readily occur to those skilled in the art. Accordingly, all such variations and modifications are included within the intended scope of the invention.

We claim:

1. Vacuum apparatus for forming metal ingots comprising hearth means for melting metallic material, outlet means for conveying molten material from the hearth means, mold means having a plurality of mold segments selectively positionable with respect to the outlet means to receive molten material from the hearth means to form a plurality of adjacent ingots in succession by static casting, and directionally controllable energy source mans for selectively direction a beam of energy toward the mold segment receiving molten metal from the outlet means to control the rate of solidification of the ingot during static casting, wherein the directionally controllable energy source means is arranged to selectively direct an energy beam toward the surface of a previously cast ingot in a mold segment adjacent to a segment receiving molten material from the outlet means.

2. Vacuum apparatus according to claim 1 wherein the mold means includes a plurality of mold segments having different cavity configurations.

3. Vacuum apparatus according to claim 1 wherein the mold means includes a mold segment shaped to form an ingot with a removable tab.

4. Vacuum apparatus according to claim 1 wherein the mold means includes a mold segment shaped to form a plurality of small ingots connected by bridges.

5. Vacuum apparatus according to claim 1 wherein the mold means comprises a plurality of mold segments mounted in spaced relation around the peripheral surface of a drum and including means for intermittently rotating the drum to place the mold segments selectively in position to receive molten metal from the outlet means.

6. Vacuum apparatus according to claim 1 including cooling means for cooling the mold means to promote solidification of molten metal in the mold means.

7. Vacuum apparatus according to claim 1 wherein the directionally controllable energy source means comprises an electron beam gun.

8. Vacuum apparatus according to claim 1 wherein the directionally controllable energy source means comprises a plasma torch.

9. Vacuum apparatus according to claim 1 wherein the mold means includes a plurality of mold segments supported in adjacent relation and including dividing means projecting above the level of the mold means to cause molten metal received by the mold means from the outlet means to flow into one or the other of the adjacent mold segments.

10. A vacuum process for sequential static casting of ingots comprising melting metal in a hearth having an outlet for molten metal, supporting a series of mold segments adjacent to the hearth outlet, directing molten metal from the hearth outlet sequentially into adjacent mold segments, directing an energy beam toward the surface of the metal in the mold segment receiving molten metal from the hearth outlet to control the solidification rate of the molten metal and directing an energy beam toward the surface of an ingot in an adjacent mold segment after the mold segment has been filled to control cooling of the ingot.

11. A method according to claim 10 including directing an energy beam toward molten metal being directed through the hearth outlet toward a mold segment to create thermal stirring currents and exclude floating material from the metal directed toward the mold segment.

12. A method according to claim 10 including selectively directing an energy beam to the surface of a solidified ingot in a mold segment to produce an identifying mark on the surface of the ingot.

* * * * *

UNITED STATES PATENT AND TRADEMARK OFFICE

CERTIFICATE OF CORRECTION

PATENT NO. : 5,291,940

DATED : March 8, 1994

INVENTOR(S) : Janine C. Borofka et al.

It is certified that error appears in the above-identified patent and that said Letters Patent is hereby corrected as shown below:

Column 4, line 35: The word "direction" should read --directing--.

Signed and Sealed this

Twenty-third Day of August, 1994

Bruce Lehman

*Attest:*

BRUCE LEHMAN

*Attesting Officer*

*Commissioner of Patents and Trademarks*